US006107922A

United States Patent [19]

Bryuzgin

[11] Patent Number: 6,107,922

[45] Date of Patent: Aug. 22, 2000

[54] DRIVER SLEEP OR FATIGUE ALARM

[76] Inventor: Andrey Bryuzgin, 1143 39th St., Apt. L-1, Brooklyn, N.Y. 11218

[21] Appl. No.: 09/352,591

[22] Filed: Jul. 14, 1999

[51] Int. Cl.[7] ..... G08B 23/00

[52] U.S. Cl. ..... 340/576; 340/575; 340/571; 340/572; 340/573; 340/461; 200/52

[58] Field of Search ..... 340/576, 575, 340/571, 572, 573, 461; 200/52

[56] References Cited

U.S. PATENT DOCUMENTS

| | | | |
|---|---|---|---|
| 2,747,038 | 5/1956 | Perkovich | 200/52 |
| 2,842,628 | 7/1958 | James | 200/52 |
| 3,045,225 | 7/1962 | Baldwin | 340/279 |
| 3,054,868 | 9/1962 | Phillians | 200/52 |
| 3,999,177 | 12/1976 | Greene | 340/279 |
| 4,234,051 | 11/1980 | Morris, Jr. | 180/272 |
| 4,259,665 | 3/1981 | Manning | 340/575 |
| 4,354,179 | 10/1982 | Fourcade | 340/575 |
| 4,359,724 | 11/1982 | Zimmerman et al. | 340/575 |
| 4,361,834 | 11/1982 | King | 340/575 |
| 4,555,697 | 11/1985 | Thackrey | 340/575 |
| 5,353,013 | 10/1994 | Estranda | 340/575 |
| 5,402,109 | 3/1995 | Mannik | 340/575 |
| 5,522,092 | 6/1996 | Streb | 2/209.13 |
| 5,585,785 | 12/1996 | Gwin | 340/575 |
| 5,684,461 | 11/1997 | Jones | 340/575 |
| 5,745,038 | 4/1998 | Vance | 340/575 |
| 5,841,354 | 11/1998 | Bae | 340/575 |

*Primary Examiner*—Jeffrey A. Hofsass
*Assistant Examiner*—Tai T. Nguyen
*Attorney, Agent, or Firm*—Boris Leschinsky

[57] ABSTRACT

A self-contained head set based sleep or fatigue alarm for a driver of a vehicle contains a set of arms extending from the alarm housing around the driver's head to the area under the driver's lower jaw. Involuntary relaxation of the driver's lower jaw causes rotation of the arms which in turn urges the movable contact against the stationary contact and therefore leads to the completion of the electrical circuit. After a predetermined delay, a buzzer or vibrator is activated to awaken the driver. In another embodiment, two relaxation motions, jaw lowering and head tilting, are used at the same time to trigger the alarm. In a third embodiment, either one of these two relaxation motions is used to trigger the alarm independently thus increasing the sensitivity of the alarm.

7 Claims, 3 Drawing Sheets

DRIVER SLEEP OR FATIGUE ALARM

BACKGROUND OF THE INVENTION

1. Field of the Invention

The present invention relates generally to alarms, and more particularly to an alarm for alerting or awakening an operator of a vehicle should the operator become sleepy while driving a vehicle. Accidents involving automobiles and trucks caused by the driver of the vehicle falling asleep or dozing at the wheel are all too common and lead to a large number of vehicular deaths and serious injuries each year. The present invention more specifically uses the involuntary lowering of the jaw of the driver as the primary indicator of an alarm state.

2. Description of the Prior Art

Devices have been proposed to awaken a driver who dozes off while operating a vehicle, but because of their complexity and cost, these devices have been less than completely satisfactory and few, if any, have been used to the extent desirable to significantly reduce the number of vehicular deaths caused by sleeping or dozing drivers. Moreover, most devices of this nature could only be installed in the automobile at the initial production stage and could not be installed as an aftermarket accessory to the vehicles, which further limits their utility and acceptance.

Examples of prior art driver's alarms can be found in many US Patents. Most of them rely on some form of involuntary muscle relaxation as a way to sense the fatigue or sleepy condition of the driver. Two most common types of relaxation used for determining the condition of the driver in the devices of the prior art are the forward tilting motion of the driver's head and relaxation of the driver's hands on the steering wheel.

U.S. Pat. No. 5,841,354 by Bae et al. describes an ear plug with an alarm module activated by the motion of tilting the driver's head. A relatively simple position sensing system comprises a metal ball closing off the electric circuit should the driver tilt his head down which in turn activates the sound device. Although simple, this device relies only on the tilting motion of the driver's head which limits its utility because that motion can happen too late in the process of a driver falling asleep.

Another hearing-aid type device is depicted in the U.S. Pat. No. 4,354,179 by Fourcade. A position sensor activates the alarm should the driver nod his head.

One more example of an alarm reacting to the motion of the tilting head is found in the U.S. Pat. No. 5,684,461 by Jones which describes a U-shaped head set equipped with a mercury switch. The switch activates the alarm once a titling motion has been detected. Multiple additional components needed for operation of this device limit its utility. A similar device is contained in the U.S. Pat. No. 3,999,177 by Greene and has a posture switch attached to a cap which activates the alarm in response to the tilting of the driver's head.

Relaxation of the driver's arms on the steering wheel of the vehicle is utilized by the alarm device according to the U.S. Pat. No. 5,585,785. A complex set of electronic components is needed to process the information on the force with which the driver holds the steering wheel. Once the force drops below a certain point, a control unit activates an audible signal to wake the driver up. Complexity of this device limits its acceptability. A similar device is described in the U.S. Pat. No. 4,259,665 by Manning.

Another alarm device attached to the driver's hands and reacting to the relaxation of the driver's hand is depicted in the U.S. Pat. No. 4,361,834 by King. A multitude of components including an ear plug and power source limits the applicability of this device.

A further example of an alarm device reacting to the tilting motion is described in the U.S. Pat. No. 5,522,092 by Streb et al. The alarm components are mounted on the cap and have to be plugged in the cigarette lighter of the car to draw electrical energy for their operation.

Operator sleep alarm is presented in the U.S. Pat. No. 5,353,013 by Estrada. This device includes an optical beam emitter and receiver after bouncing off the reflective component mounted again in the driver's cap. Tilting the head causes the beam not to be reflected back at the receiver and triggers an alarm condition. This device requires a complex optical system to be installed in the vehicle and also limits the free motion range for the driver when completely awake in order not to trigger false activation of the alarm unit.

Teeth-held tilt alarm is described by Thackery in his U.S. Pat. No. 4,555,697. This completely self-contained unit has to be held by the driver's jaws in a certain position. Tilting the head causes a posture switch to activate the alarm and vibratory motion is transmitted through the teeth to the skull of the driver. The basic limitation of the alarm is the appearance of the driver wearing it and also inability to speak freely while in use.

All above mentioned devices use only one primary type of relaxation of the driver such as the tilting motion of the driver's head or the relaxation of the driver's hand which limits the reliability of the detection of the alarm state. Falling asleep is a complex phenomenon and involves a multitude of muscles. In addition to the tilting motion of the head, it is known for example that the sleepy condition of a person is characterized by involuntary lowering of a lower jaw. This particular relaxation motion has not been utilized by the devices of the prior art but represents a reliable indication of the driver falling asleep. Therefore, the need exists for a comprehensive but simple and compact alarm device which is capable of detecting the sleepy condition of the driver as a result of more than one relaxation type. The device at the same time should be self-contained, light and simple in use to ensure its acceptance by drivers.

SUMMARY OF THE INVENTION

Accordingly, it is an object of the present invention to overcome these and other drawbacks of the prior art by providing a driver's alarm capable of determining the fatigued or sleepy condition of the driver and subsequently triggering an alarm condition by detecting the lowering motion of the driver's lower jaw.

It is another object of the present invention to provide an alarm with reduced number of false activations by utilizing more than one relaxation motions of the operator of a vehicle such as the lowering of the lower jaw and tilting of the head.

It is a further object of the present invention to provide an alarm increased sensitivity to the driver falling asleep by utilizing any of several relaxation motions to trigger an alarm condition such as lowering of a lower jaw or tilting of the head.

As can be appreciated by those skilled in the art, a process of falling asleep is a complicated physiological phenomenon. Ultimately, most muscles of a sleeping person are completely relaxed. In case of a tired or fatigued automobile driver, many muscles of the body start to become relaxed once the driver is falling asleep. Even in the semi-sleepy or dozing condition, certain muscles are already involuntary relaxed which can be used to detect that physiologic condition of the driver. The present invention utilizes a novel approach of monitoring the position of a driver's lower jaw as an indicator of the driver's condition. Once the driver relaxes his lower jaw and therefore the jaw moves downwardly even before the mouth is visibly opened, the device is designed to detect that motion and trigger an alarm condition.

A novel alarm according to the present invention is designed as a self-contained U-shaped headset adapted to be placed on the driver's head. One side of the alarm contains a housing for the alarm components including a trigger, a power source, a speaker or a vibrator, an activation switch, and a control unit. An adjustable arcuate arm is extending from the alarm housing down along the side of the driver's head and ending under the driver's jaw. Upon activation of the alarm switch, the lowering of the driver's jaw leads to the pulling motion on the arcuate arm which in turn activates the trigger. Alarm speaker is turned on by a delay unit after predetermined delay if the jaw is not returned to its initial position.

In a variation of this device and still according to the present invention, a tilting motion detector is also contained in the alarm housing. It can be wired to cause the activation of the alarm speaker in series with the main trigger sensing the position of the jaw in order to reduce the number of false activations and in essence requiring that both relaxation motions are present. Alternately, it can be wired in parallel to the main trigger in which case either of the relaxation motions would trigger an alarm condition thus increasing the sensitivity of the device.

For a better understanding of the invention, its operating advantages and the specific objects attained by its uses, reference should be made to the accompanying drawings and descriptive matter in which there is illustrated preferred embodiments of the present invention.

BRIEF DESCRIPTION OF THE DRAWINGS

A more complete appreciation of the subject matter of the present invention and the various advantages thereof can be realized by reference to the following detailed description in which reference is made to the accompanying drawings in which:

FIG. 2 is view A, a perpendicular top view to the arcuate arm of the alarm device according to the first embodiment on FIG. 1;

FIGS. 3A and 3B are the cross-sectional views on line B—B on FIG. 1 illustrating the spring-loaded motion of the arcuate arm of the alarm device of the first embodiment;

FIG. 4 is a view of a detail of the head set of the alarm on FIG. 1;

FIG. 6 is a view of a detail of the head set of the alarm on FIG. 5;

DETAILED DESCRIPTION OF THE FIRST MOST PREFERRED EMBODIMENT OF THE INVENTION

Figure 1:
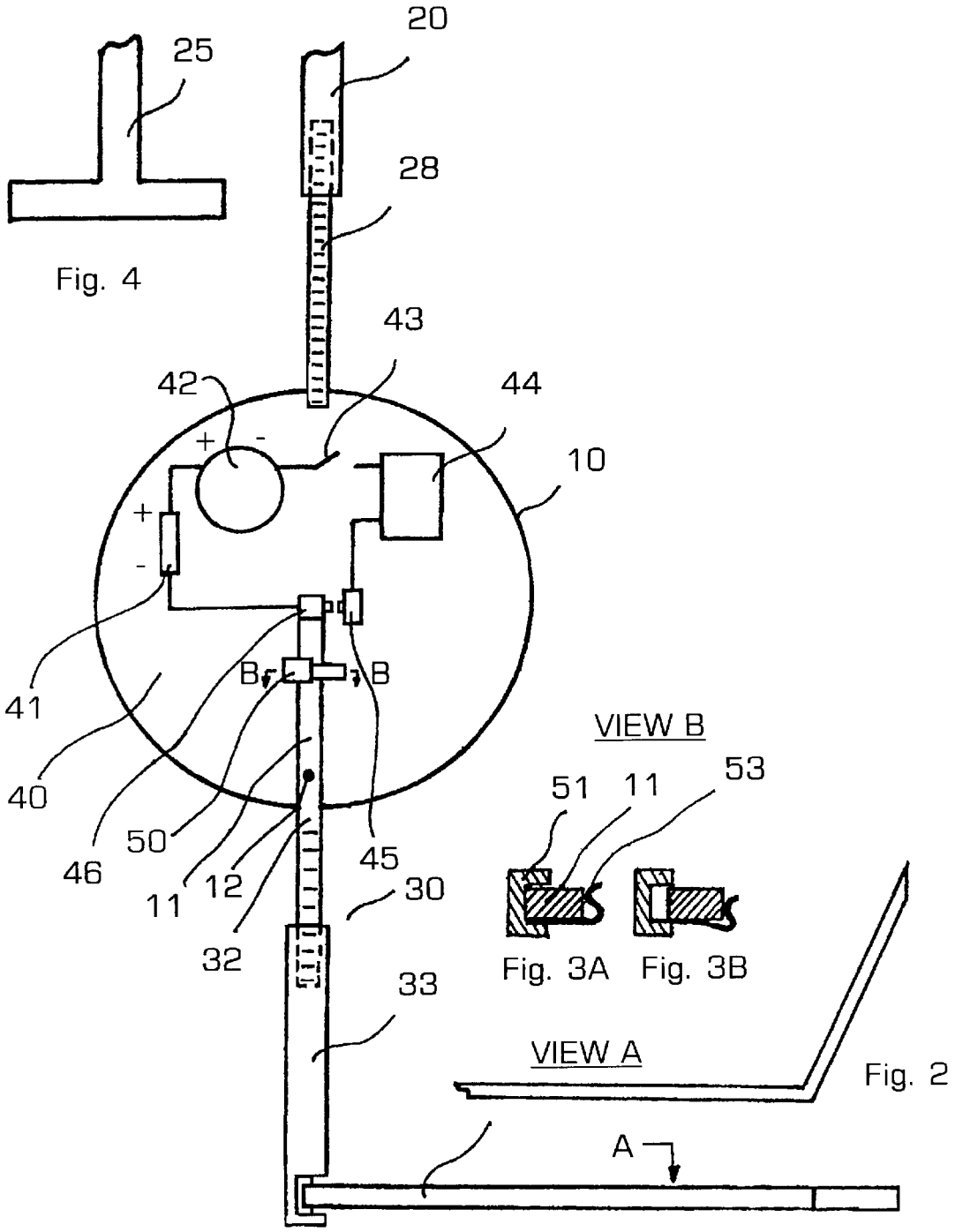
FIG. 1 is a highly schematic view of the alarm device according to the first embodiment of the invention containing an adjustable arcuate arm for sensing the position of the lower jaw of the driver.

A detailed description of the present invention follows with reference to accompanying drawings in which like elements are indicated by like reference numerals.

FIG. 1 is a schematic view of the alarm device according to the first and most preferred embodiment of the present invention. The alarm comprises a U-shaped head set (20) designed to position the alarm about the driver's head. It should be understood that other means of placement the alarm about the head of the driver are also possible and are intended to be included in the spirit of the invention. The advantage of the head set arrangement, however, is that is offers a familiar and light configuration and does not require additional training for putting it on. The head set (20) contains an adjustable arm (28) and a T-shaped bar (25) as shown on FIG. 4, all designed to allow for a secure fit over the head of the driver.

The alarm housing (10) is positioned on the other side of the head set (20) opposite the T-shaped bar (25) and contains the electronic block (40). A detector of a jaw position (30) extends downwardly from the housing (10) and comprises an arm (11) with adjustable element (32), an arcuate arm (33) and a lower arm (35) designed to be capable of turning around the lower part of arm (33) so as to ease the positioning of the alarm on the head of the driver. As shown on FIG. 2, the end of the arm (35) may be bent to follow the contours of the human face. All the elements of the detector of the jaw position are designed in such a way so as to place the extended end of the arm (35) directly under the lower jaw of the driver with the minimal clearance of about 5–10 mm.

Electronic block (40) contains several key components of the alarm: a power source (41), typically a battery but other sources are also conceived of, the power source (41) connected to the awakening device (42) such as a buzzer or a speaker, typically of piezoelectric design. Silent alarm vibrators may be used as an awakening device (42) so as not to disturb the passengers of the vehicle, for example in case of a limousine driver. In turn, the output of the speaker (42) is connected to the input of the alarm's switch (43) which is optionally included to allow disabling of the whole device if desired. The output of the switch (43) is connected to the delay unit (44), typically a small electronic chip, the main function of which is to postpone activation of the alarm by a predetermined amount of time of about 2 to 10 seconds in order to filter out natural movements of the driver's jaws when filly awake. Thus, the delay unit (44) is included to eliminate false activations of the alarm.

The output of the delay unit (44) is connected to the stationary contact (45), which in combination with the opposite movable contact (46) forms a pair of contacts designed to be closed off by the detector of the jaw position (30). In turn, the movable contact (46) is connected by flexible wire to the power source (41) which completes the electrical circuit of the alarm.

Arm (32) is designed in such a way as to move the contact (46) towards the contact (45) in case of the lowering of the driver's jaw. For that purpose, the lower part of the arm (32) is capable of rotating around the axis (12) and therefore causing the upper part (11) to move the contact (46). The arm (11) is spring-biased to return it back to the initial position by the element (50) shown in cross-section on FIGS. 3A and 3B as having a stop (51) and a spring (53). FIG. 3A shows the arm (11) in neutral position against the stop (51), while FIG. 3B shows the arm (11) in alarm position and extending the spring (53).

In use, the device has to be first placed about the head of the driver by positioning the head set part and adjusting the length of the arm (28) to ensure a snug fit. The length of the arcuate arm (33) is then adjusted and the lower arm is rotated into position so that the extended end of the arm is placed just below the lower jaw of the driver at a predetermined distance of about 5 to 10 mm. Once completed, the switch (43) is turned on and the device is ready for use.

Under normal fully awaken condition, the driver's jaw is retained in the most upper position However, once the driver starts to fall asleep behind the wheel, the jaw muscles are relaxed and the jaw slowly moves downwardly thus depressing the lower arm (35). That motion in turn causes the arm (32) to rotate about the axis (12) and therefore the movable contact (46) is placed against the stationary contact (45) completing the electrical circuit of the alarm. However, even in this state the alarm would not be activated since the delay unit (44) postpones that step by a predetermined interval of time, typically about 2–10 seconds to eliminate the false activations due to driver talking or opening the mouth for other reasons. After the time has elapsed and if the contacts are still connected, the alarm condition is activated and the speaker or a vibrator is turned on until the driver is awaken and the jaw is returned to its naturally retained position.

Removal of the device is achieved in the opposite manner, namely by turning off the switch (43) and turning the lower arm (35) away from under the lower jaw. After that the alarm is removed from the driver's head.

DETAILED DESCRIPTION OF THE SECOND PREFERRED EMBODIMENT OF THE INVENTION

Figure 5:
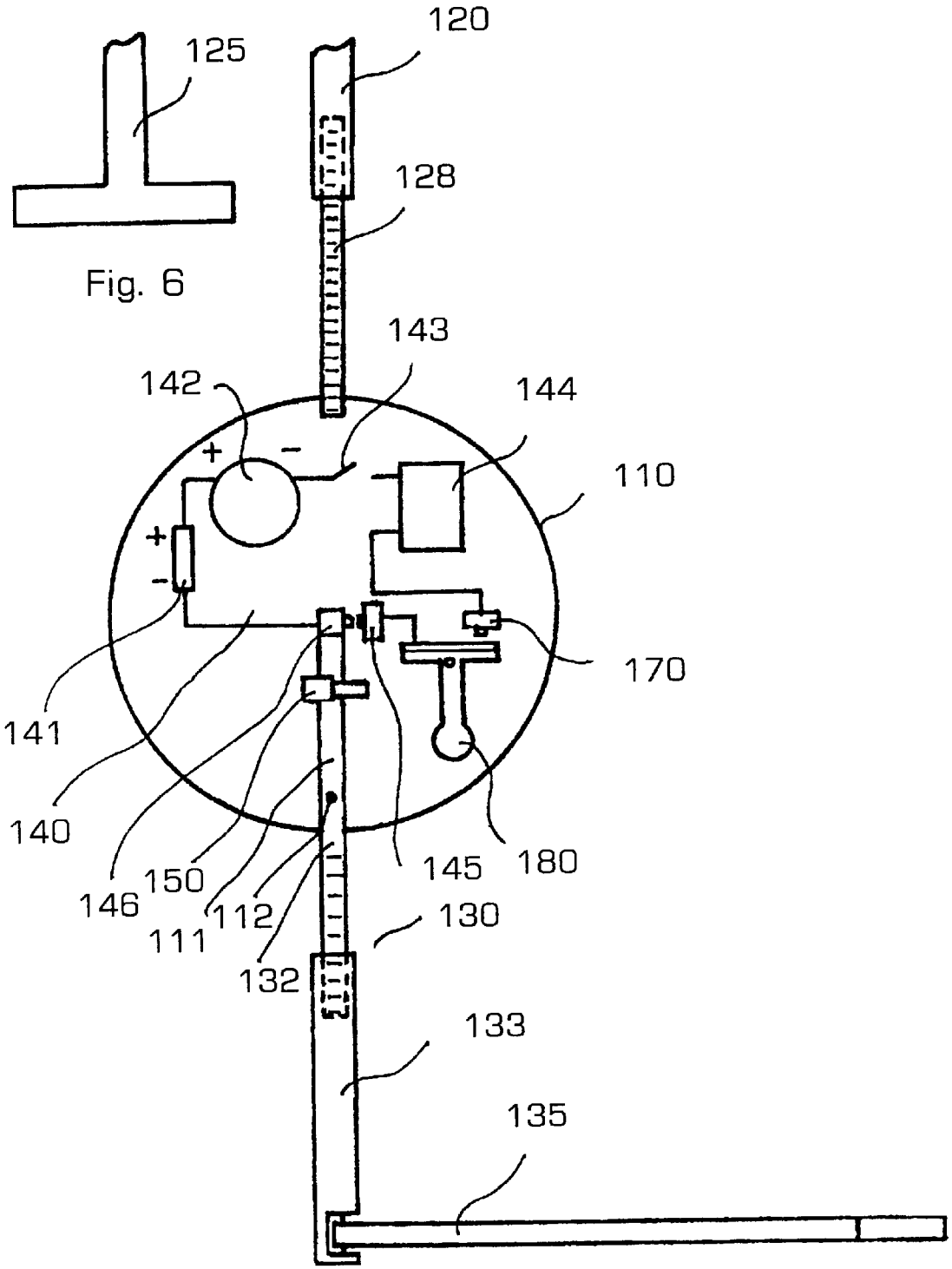
FIG. 5 a highly schematic view of the alarm according to the second embodiment of the present invention in which an additional tilting motion detector is incorporated in series with the jaw position detector of the first embodiment.

FIG. 5 is a schematic view of the alarm device according to the second embodiment of the present invention. This embodiment is designed to reduce the number of false alarms by utilizing more than one relaxation motion of the driver. In order to activate the speaker of the alarm, at least two relaxation motions have to be completed at the same time. In this embodiment, in addition to the lowering of the driver's jaw, the motion of head tilting is also used as an indicator of a sleepy condition.

The alarm comprises a U-shaped head set (120) designed to position the alarm about the driver's head in a similar manner as with the alarm of the first embodiment. The head set (120) contains an adjustable arm (128) and a T-shaped bar (125) as shown on FIG. 6, all designed to allow for a secure fit over the head of the driver.

The alarm housing (110) is positioned on the other side of the head set (120) opposite the T-shaped bar (125) and contains the electronic block (140). A detector of a jaw position (130) extends downwardly from the housing (110) and comprises an arm (111) with adjustable element (132), an arcuate arm (133) and a lower arm (135) designed to be capable of turning around the lower part of the arcuate arm (133) so as to help in the positioning of the alarm device on the head of the driver. The end of the arm (135) may be bent to follow the contours of the human face similar to the previous embodiment of the present invention. All the elements of the detector of the jaw position are designed in such a way so as to place the extended end of the lower arm (135) directly under the lower jaw of the driver with the minimal clearance of about 5–10 mm.

Electronic block (140) contains several key components of the alarm: a power source (141) connected to the speaker (142), typically of piezoelectric design. Silent alarm vibrators may be used in place of the speaker (142) so as not to disturb the passengers of the vehicle. In turn, the output of the speaker (142) is connected to the input of the alarm's switch (143) which is optionally included to allow disabling of the whole device if desired. The output of the switch (143) is connected to the delay unit (144), typically a small electronic chip, the main function of which is to postpone activation of the alarm by a predetermined amount of time of about between 2 and 10 seconds in order to filter out natural movements of the driver's jaws when fully awake. Thus, the delay unit (144) is included to eliminate false activations of the alarm.

The output of the delay unit (144) is connected to the stationary contact (170), which forms a contact pair with the movable contact (171) of the pendulum (180). The pendulum (180) tilting about the axis (160) is designed to detect the tilting of the driver's head. Other well known position detectors such as a mercury switch may be used instead of the pendulum (180).

The output of the pendulum (180) is connected by flexible wire to the input of the stationary contact (145) which in combination with the opposite movable contact (146) forms a pair of contacts designed to be closed off by the detector of the jaw position (130). In turn, the movable contact (146) is connected by flexible wire back to the power source (141) which completes the electrical circuit of the alarm.

Arm (132) is designed in such a way as to move the contact (146) towards the contact (145) in case of the lowering of the driver's jaw. For that purpose, the lower part of the arm (132) is capable of rotating around the axis (112) and therefore causing the upper part (111) to move the contact (146). The arm (111) is spring-biased to return it back to the initial position by the element (150) which is of similar design as the one shown in cross-section on FIGS. 3A and 3B.

In use, the device has to be first placed about the head of the driver by positioning the head set part and adjusting the length of the arm (128) to ensure a snug fit. The length of the arcuate arm (133) is then adjusted and the lower arm (135) is rotated into position so that the extended end of the arm is placed just below the lower jaw of the driver at a predetermined distance of about 5 to 10 mm. Once completed, the switch (143) is turned on and the device is ready for use.

Under normal fully awaken condition, the driver's jaw is retained in the most upper position and the head is kept straight. However, once the driver starts to fall asleep behind the wheel, the jaw muscles are relaxed and the jaw slowly moves downwardly thus depressing the lower arm (135). That motion in turn causes the arm (132) to rotate about the axis (112) and therefore the movable contact (146) is placed against the stationary contact (145). At the same time, the tilting motion of the driver's head causes the alarm housing to tilt along with the driver's head while the pendulum (180) remains in place therefore urging the contact (171) towards the contact (170) thus completing the electrical circuit of the alarm. However, even in this state the alarm would not be activated since the delay unit (144) postpones that step by a predetermined interval of time, typically about 2–10 seconds to eliminate the false activations due to driver bending the head, talking or opening the mouth for other reasons. After the time has elapsed and if the contacts are still connected, the alarm condition is activated and the speaker or a vibrator (142) is turned on until the driver is awaken and the jaw or the head is returned to its naturally retained position.

Removal of the device is achieved in the opposite manner, namely by turning off the switch (143) and tuning the lower arm (135) away from under the lower jaw. After that the alarm is removed from the driver's head.

DETAILED DESCRIPTION OF THE THIRD PREFERRED EMBODIMENT OF THE INVENTION

Figures 7, 8:
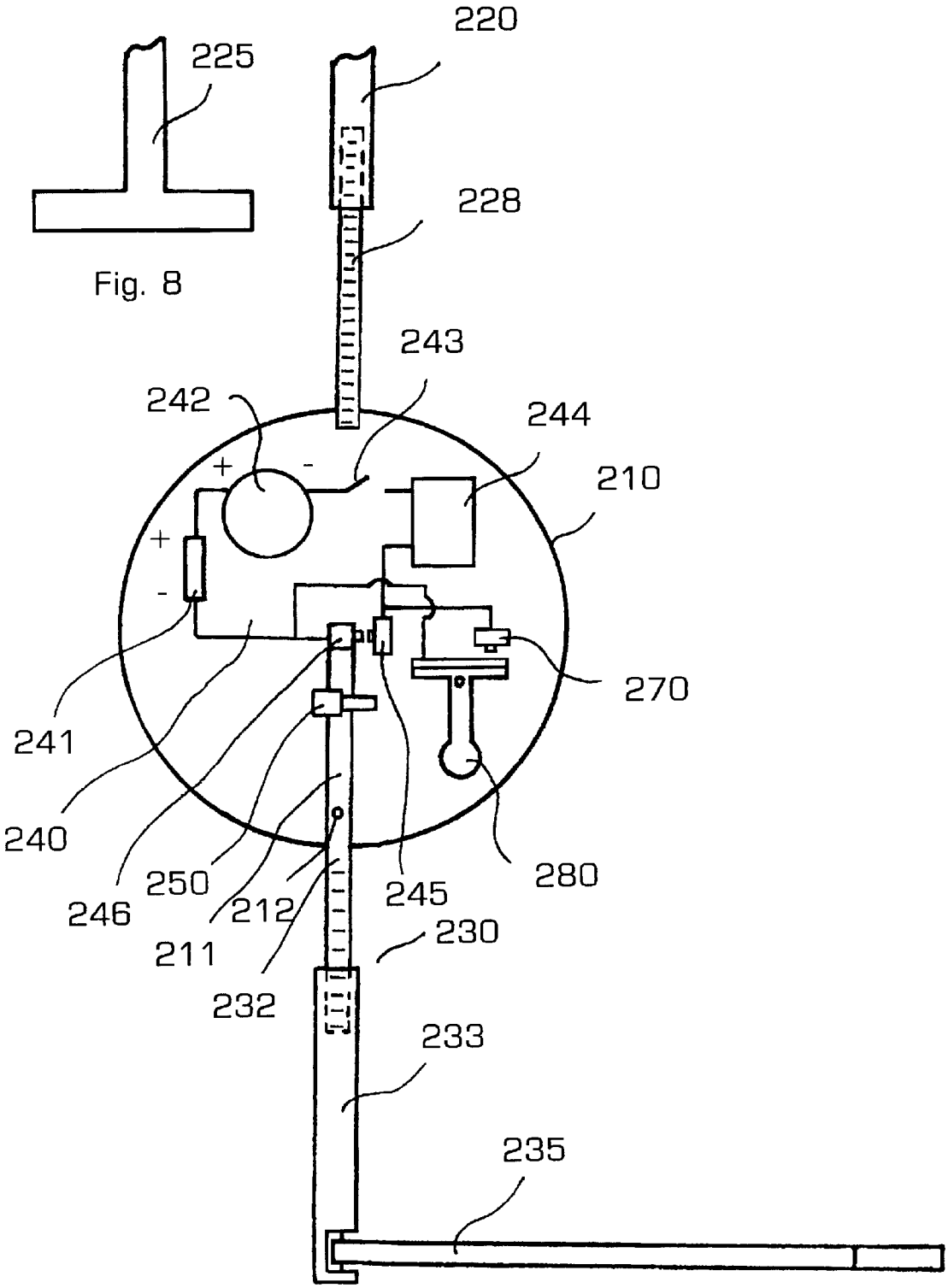
FIG. 7 is a highly schematic view of the alarm according to the third embodiment of the invention incorporating a tilting motion detector in parallel to the jaw position detector of the first embodiment.
FIG. 8 is a view of a detail of the head set of the alarm on FIG. 7.

FIG. 7 is a schematic view of the alarm device according to the third embodiment of the present invention. This embodiment is designed to increase the sensitivity of the alarm by utilizing either one of more than one relaxation motion of the driver. In order to activate the speaker of the alarm, any one of the two relaxation motions have to be completed. In this embodiment, in addition to the lowering of the driver's jaw, the motion of head tilting is also used as an indicator of a sleepy condition. At the same time, other relaxation motions can also be used using the same principle such as relaxation of the driver's hands on the steering wheel.

The alarm comprises a U-shaped head set (220) designed to position the alarm about the driver's head in a similar manner as with the alarm of the first two embodiments. The head set (220) contains an adjustable arm (228) and a T-shaped bar (225) as shown on FIG. 8, all designed to allow for a secure fit over the head of the driver.

The alarm housing (210) is positioned on the other side of the head set (220) opposite the T-shaped bar (225) and contains the electronic block (240). A detector of a jaw position (230) extends downwardly from the housing (210) and comprises an arm (211) with adjustable element (232), an arcuate arm (233) and a lower arm (235) designed to be capable of turning around the lower part of the arcuate arm (233) so as to help in the positioning of the alarm device on the head of the driver. The end of the arm (235) may be bent to follow the contours of the human face similar to the previous embodiments of the present invention. All the elements of the detector of the jaw position are designed in such a way so as to place the extended end of the lower arm (235) directly under the lower jaw of the driver with the minimal clearance of about 5–10 mm.

Electronic block (240) contains several key components of the alarm: a power source (241) connected to the speaker (242). Silent alarm vibrators may be used in place of the speaker (142). In turn, the output of the speaker (242) is connected to the input of the alarm's switch (243) which is optionally included to allow disabling of the whole alarm device if desired. The output of the switch (243) is connected to the delay unit (244) the main function of which is to postpone activation of the alarm by a predetermined amount of time of about between 2 and 10 seconds in order to filter out natural movements of the driver's jaws or the head when fully awake. Thus, the delay unit (244) is included to eliminate false activations of the alarm.

The output of the delay unit (244) is connected in parallel both to the stationary contacts (270) and (245). Stationary contact (270) forms a contact pair with the movable contact (271) of the pendulum (280). The pendulum (280) is designed to detect the tilting of the driver's head.

At the same time, the stationary contact (245) forms a contact pair with the movable contact (246) capable of being moved by the arm (211). Arm (232) is designed in such a way as to move the contact (246) towards the contact (245) in case of the lowering of the driver's jaw. For that purpose, the lower part of the arm (232) is capable of rotating around the axis (212) and therefore causing the upper part (211) to move the contact (246). The arm (211) is spring-biased to return it back to the initial position by the element (250) which is of similar design as the one shown in cross-section on FIGS. 3A and 3B.

The output of the pendulum (280) and the movable contact (246) are connected in parallel back to the power source (241) which completes the electrical circuit of the alarm.

In use, the device has to be first placed about the head of the driver by positioning the head set part and adjusting the length of the arm (228) to ensure a snug fit. The length of the arcuate arm (233) is then adjusted and the lower arm (235) is rotated into position so that the extended end of the arm is placed just below the lower jaw of the driver at a predetermined distance of about 5 to 10 mm. Once completed, the switch (243) is turned on and the device is ready for use.

Under normal conditions, the driver's jaw is retained in the most upper position and the head is kept straight. However, once the driver starts to fall asleep behind the wheel, the jaw muscles are relaxed and the jaw slowly moves downwardly thus depressing the lower arm (235). That motion in turn causes the arm (232) to rotate about the axis (212) and therefore the movable contact (246) is placed against the stationary contact (245). That event alone completes the electrical circuit of the alarm and is enough to trigger the alarm condition after a predetermined delay.

Independently, the tilting motion of the driver's head causes the alarm housing to tilt along with the driver's head while the pendulum (280) remains in place therefore urging the contact (271) towards the contact (270) thus completing by itself the electrical circuit of the alarm as well and triggering the alarm condition after the delay unit (244) postpones it by a predetermined interval of time of about 2–10 seconds.

After awakening of the driver, the speaker will shut off once the head and the jaw are both returned to their respective initial positions.

Removal of the device is achieved in the opposite manner, namely by turning off the switch (243) and turning the lower arm (235) away from under the lower jaw. After that the alarm is removed from the driver's head.

Although the present invention has been described with respect to several specific embodiments and applications, it is not limited thereto. Numerous variations and modifications readily will be appreciated by those skilled in the art and are intended to be included within the scope of the present invention, which is recited in the following claims.

What I claim is:

1. A sleep or fatigue alarm for a driver of a vehicle comprising:

a head set of U-shaped configuration for positioning the alarm about the driver's head;

an alarm housing positioned on the head set;

an electric circuit placed inside said housing, said circuit including a power source, an awakening means, a delay unit, first pair of contacts and a second pair of contacts connected in series to the first pair of contacts;

a jaw position detecting means for activating the alarm in response to involuntary lowering of the driver's lower jaw, said means capable of closing off the first pair of contacts of the electrical circuit, and a tilt detection means for detecting the tilting motion of the driver's head and subsequently activating the alarm, said means capable of closing off the second pair of contacts of the electrical circuit, whereby the alarm being triggered after a predetermined delay in response to the sleep or fatigue condition of the driver as being detected from both the lowering of the driver's lower jaw and the tilting of the driver's head.

2. The alarm as in claim 1, wherein said first pair of contacts having a first stationary contact and a first movable contact; said jaw position detecting means comprising a set of arms extending downwardly from said alarm housing, said set including an arcuate arm having an upper end, an axis of rotation affixed to the housing and a lower end; and a lower arm extending from the lower end of said arcuate arm to the area under the driver's lower jaw; said first movable contact positioned about said upper end of said arcuate arm, whereby the lowering of the driver's jaw causing rotation of the arcuate arm and further causing the first movable contact to be placed against the first stationary contact of the electrical circuit.

3. The alarm as in claim 1, wherein said tilt detection means further comprising a pendulum rotatably attached to said alarm housing, the second pair of contacts further comprising a second stationary contact and a second movable contact, said second movable contact attached to said pendulum, whereby the tilting motion of the driver's head causing the alarm to tilt along the driver's head while said pendulum remains in place further causing the second movable contact to be placed against the second stationary contact of the electrical circuit.

4. A sleep or fatigue alarm for a driver of a vehicle comprising:

a head set of U-shaped configuration for positioning the alarm about the driver's head;

an alarm housing positioned on the head set;

an electric circuit placed inside said housing, said circuit including a power source, an awakening means, a delay unit, first pair of contacts and a second pair of contacts connected in parallel to the first pair of contacts;

a jaw position detecting means for activating the alarm in response to involuntary lowering of the driver's lower jaw, said means capable of closing off the first pair of contacts of the electrical circuit, and a tilt detection means for detecting the tilting motion of the driver's head and subsequently activating the alarm, said means capable of closing off the second pair of contacts of the electrical circuit, whereby the alarm being triggered after a predetermined delay in response to the sleep or fatigue condition of the driver as being detected from either the lowering of the driver's lower jaw or the tilting of the driver's head.

5. The alarm as in claim 4, wherein said first pair of contacts having a first stationary contact and a first movable contact; said jaw position detecting means comprising a set of arms extending downwardly from said alarm housing, said set including an arcuate arm having an upper end, an axis of rotation affixed to the housing and a lower end; and a lower arm extending from the lower end of said arcuate arm to the area under the driver's lower jaw; said first movable contact positioned about said upper end of said arcuate arm, whereby the lowering of the driver's jaw causing rotation of the arcuate arm and further causing the first movable contact to be placed against the first stationary contact of the electrical circuit.

6. The alarm as in claim 4, wherein said tilt detection means further comprising a pendulum rotatably attached to said alarm housing, the second pair of contacts further comprising a second stationary contact and a second movable contact, said second movable contact attached to said pendulum, whereby the tilting motion of the driver's head causing the alarm to tilt along the driver's head while said pendulum remains in place further causing the second movable contact to be placed against the second stationary contact of the electrical circuit.

7. A sleep or fatigue alarm for a driver of a vehicle comprising:

a head set of U-shaped configuration for positioning the alarm about the driver's head;

an alarm housing positioned on the head set;

an electric circuit placed inside said housing, said circuit including a power source, an awakening means, a delay unit, and a pair of contacts, said pair of contacts having a stationary contact and a movable contact; and a jaw position detecting means for activating the alarm in response to involuntary lowering of the driver's lower jaw, said jaw position detecting means capable of closing off the pair of contacts of the electrical circuit, said jaw position detecting means comprising a set of arms extending downwardly from said alarm housing, said set including an arcuate arm having an upper end, an axis of rotation affixed to the housing and a lower end; and a lower arm extending from the lower end of said arcuate arm to the area under the driver's lower jaw;

whereby the alarm being triggered after a predetermined delay in response to the sleep or fatigue condition of the driver as being detected from the lowering of the driver's lower jaw causing rotation of the arcuate arm and further causing the movable contact to be placed against the stationary contact of the electrical circuit.

* * * * *